US008616030B2

(12) United States Patent
Hoppe et al.

(10) Patent No.: US 8,616,030 B2
(45) Date of Patent: Dec. 31, 2013

(54) PORTHOLE DOOR FOR A FRONT-LOADING LAUNDRY APPLIANCE, SUCH AS A WASHING MACHINE, A WASHER-DRYER MACHINE, OR A LAUNDRY DRYER

(75) Inventors: Holger Hoppe, Beckum (DE); Joerg Kempe, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1628 days.

(21) Appl. No.: 11/828,560

(22) Filed: Jul. 26, 2007

(65) Prior Publication Data

US 2008/0028804 A1 Feb. 7, 2008

(30) Foreign Application Priority Data

Aug. 2, 2006 (DE) ..... 10 2006 036 352

(51) Int. Cl.
*D06F 17/00* (2006.01)

(52) U.S. Cl.
USPC ..... 68/196

(58) Field of Classification Search
USPC ..... 134/200; 68/140, 196; 220/252
See application file for complete search history.

(56) References Cited

U.S. PATENT DOCUMENTS 7,299,666 B2 * 11/2007 Geyer et al. ..... 68/196
2004/0050117 A1 3/2004 Geyer et al.

FOREIGN PATENT DOCUMENTS

| | | | |
|---|---|---|---|
| DE | 19515040 | | 10/1996 |
| DE | 10053413 | | 5/2002 |
| DE | 10137918 | | 1/2003 |
| EP | 1281804 | A1 * | 2/2003 |
| EP | 1762650 | A2 | 3/2007 |
| WO | WO 0234994 | A1 * | 5/2002 |

OTHER PUBLICATIONS

Machine Translation of Friesen et al. EP 1281804, Feb. 2003.*

* cited by examiner

*Primary Examiner* — David Cormier
(74) *Attorney, Agent, or Firm* — Leydig, Voit & Mayer, Ltd.

(57) ABSTRACT

A porthole door for a front-loading laundry appliance includes a door glass, a frame and a centering device. The door glass is curved inward toward an inside of the appliance. The frame includes an inner ring and a cover ring. The centering device is disposed on the frame and configured to bear resiliently against a peripheral edge of the door glass so as to provide a radial force acting on the door glass via the peripheral edge at various locations. The radial force brings the door glass into a centered position within the frame.

16 Claims, 6 Drawing Sheets

PORTHOLE DOOR FOR A FRONT-LOADING LAUNDRY APPLIANCE, SUCH AS A WASHING MACHINE, A WASHER-DRYER MACHINE, OR A LAUNDRY DRYER

Priority is claimed to German patent application DE 10 2006 036 352.3, filed Aug. 2, 2006, and which is hereby incorporated by reference herein.

The present invention relates to a porthole door for a front-loading laundry appliance, such as a washing machine, a washer-dryer machine, or a laundry dryer, the porthole door including a door glass, a frame having an inner ring and a cover ring, and further including a substantially transparent observation window.

BACKGROUND

A porthole door for a front-loading laundry appliance is described in DE 100 53 413 A1. The porthole door includes a door glass which is curved toward the inside of the appliance and has a frame composed of a visible cover frame and a holding frame, which is concealed when in a closed position. The door glass is held by its edge between the cover frame and the holding frame. In order to achieve optimal centering of the door glass, the inner diameter of the holding frame is sized to match the contact region of the door glass very accurately, i.e., with a small tolerance. An additional observation window on the outside of the porthole door covers the door glass curvature, which is directed to the inside of the appliance. The edge of the cover is located in a visible area on the outside. A snug fit is achieved by a clamped connection, which is provided by an axially outwardly facing edge lip of the cover frame pressing on the edge of the observation window. In this holding arrangement, the observation window and the cover frame must have a high degree of dimensional accuracy, because otherwise it is not possible to ensure a firm and permanent clamped connection. Slight deviations in dimensional accuracy may result in the inability to assemble the components, or in the necessity of ensuring a centered orientation when the gaps are too large. Moreover, if the door glass and/or the viewing pane is/are not centered, there is a risk of the door not bearing evenly against the door seal and not closing completely tight.

German Patent DE 195 15 040 C2 also describes a porthole door having an observation window. In that patent, the observation window is at least partially clamped against a resilient ring under a projection of the edge of the cover frame. In this arrangement, there is a visible gap between the edge of the observation window and the inner edge of the cover frame. Moreover, in order that the visible gap be very small and not have any visible irregularities, the observation window and the cover frame must have a dimensional accuracy within a small tolerance range.

German patent DE 101 37 918 C1 describes a door for a front-loading laundry appliance suitable for integration into a row of kitchen units. In that patent, the door glass is mounted on a closed front panel. For ease of assembly, a centering ring having a raised peripheral edge is attached to the front panel. The inner diameter of the door glass is put over the edge, thereby moving the door glass to the intended position. The centering ring is elastic in some portions, making it possible to compensate for differences in height of the peripheral edge of the door glass.

SUMMARY

In view of the above, it is an aspect of the present invention to provide a porthole door having improved dimensional accuracy and tightness.

In an embodiment, the present invention provides a porthole door for a front-loading laundry appliance. The porthole door includes a door glass, a frame and a centering device. The door glass is curved inward toward an inside of the appliance. The frame includes an inner ring and a cover ring. The centering device is disposed on the frame and configured to bear resiliently against a peripheral edge of the door glass so as to provide a radial force acting on the door glass via the peripheral edge at various locations so as to bring the door glass into a substantially centered position within the frame.

BRIEF DESCRIPTION OF THE DRAWINGS

An exemplary embodiment of the present invention is shown in the drawings in a schematic way and will be described in more detail below. In the drawings.

DETAILED DESCRIPTION

Figure 1:
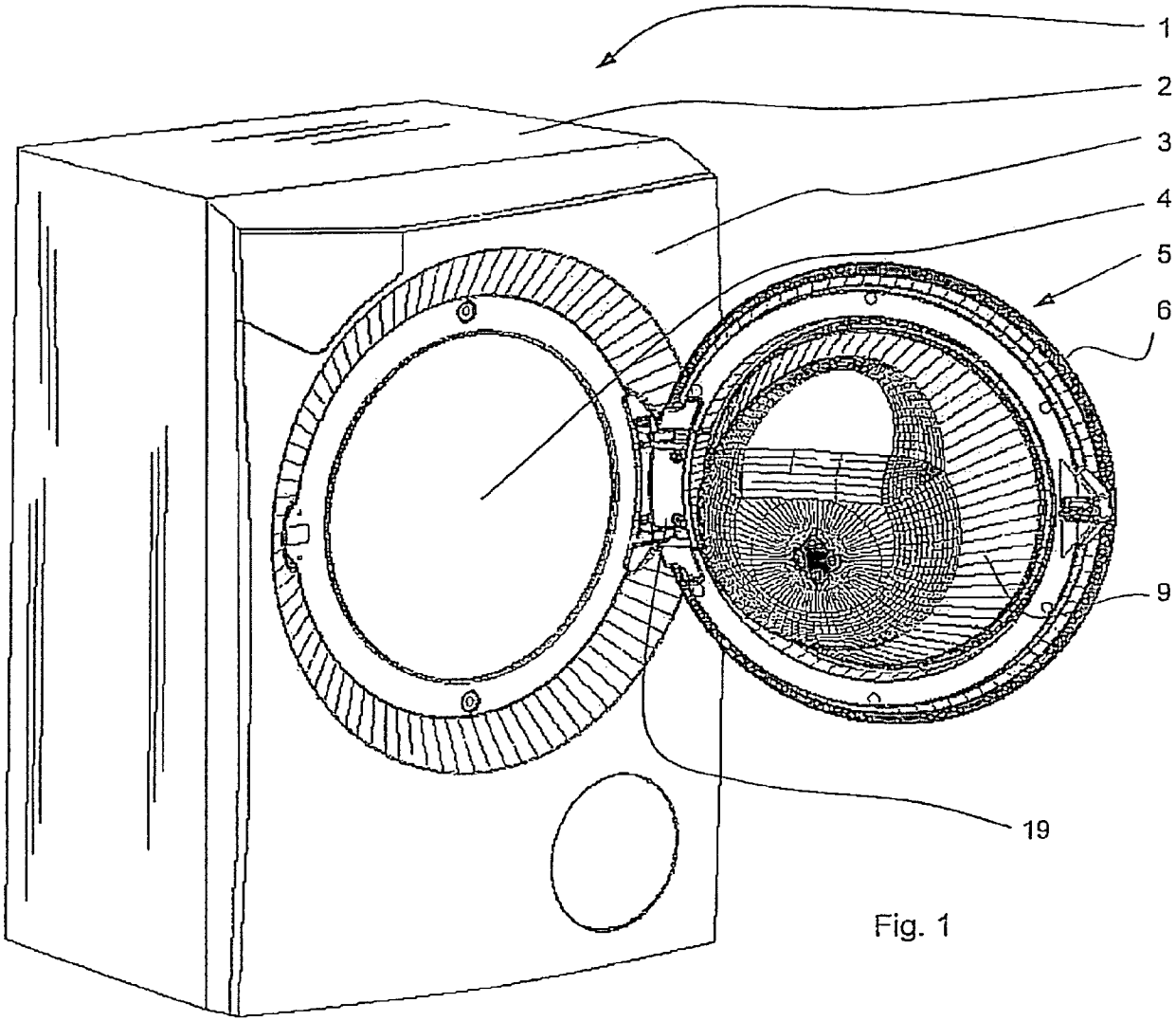
FIG. 1 shows a front-loading laundry appliance.

In addition to an accurate dimensional relationship between the individual parts, a further advantage offered by the present invention is the good and reliable tightness of the door. In the closed position, the door glass protrudes into the loading opening and bears against the door seal surrounding the edge of the loading opening. The uniform contact therebetween provides reliable tightness. The dimensional accuracy of the door glass within the frame is provided by at least one centering means located on the frame. The centering means bears resiliently against the peripheral edge of the door glass, thereby placing the door glass in a substantially centered position within the frame. The centering means produces/produce a radial force acting on the edge of the door glass, respectively; said force acting on the door glass at various locations via the peripheral edge. This automatically results in a substantially centered position of the door glass within the frame.

In another embodiment, the porthole door is provided on the outside with an observation window covering the curvature of the door glass which at least partially protrudes into the loading opening. The frame has disposed thereon at least one additional centering means which bears resiliently against the peripheral edge of the observation window, thereby placing the observation window in a substantially centered position within the frame. Centering is accomplished in the same way as for the door glass.

In both cases, it is convenient that the centering means has a plurality of resilient elements circumferentially distributed in a substantially uniform manner, the centering means including resilient elements for the door glass and, further, resilient elements for the observation window. The action of the resilient elements for the door glass is not affected by the observation window, so that the centering of the door glass is accomplished independently of the centering of the observation window.

In an embodiment, the centering means takes the form of a segment of a circular ring. The respective segments have disposed thereon the resilient elements for the door glass and the resilient elements for the observation window, a plurality of circular ring segment shaped centering means being arranged circumferentially around the edge of the door glass and/or of the observation window on the cover ring or on the inner ring of the frame.

In another embodiment, the centering means includes a ring having disposed thereon the resilient elements for the door glass and the observation window, the ring being disposed on and/or secured to cover ring or inner ring of the frame. The fixed arrangement of the resilient elements ensures that the resilient elements are retained in their predetermined positions, respectively. This prevents the resilient elements from being displaced during assembly or during operation of the laundry appliance.

For this purpose, it is convenient that the centering means is integrally formed in one piece with the ring and the resilient elements. Due to the small number of component parts, the centering means can be easily manufactured, for example, as a stamped and bent metal part, or as an injection-molded plastic part. Furthermore, only single part needs to be taken into account during assembly.

The front-loading laundry appliance 1 shown in FIG. 1 includes a housing 2 having a loading opening 4 disposed in front wall 3. A porthole door 5 is mounted to front wall 3 by a hinge 19. Porthole door 5 is composed of a frame 6 and a door glass 9 surrounded by frame 6. Loading opening 4, which is disposed in front wall 3, can be closed by porthole door 5, door glass 6 sealingly bearing against a door seal surrounding the edge of loading opening 4.

Figure 2:
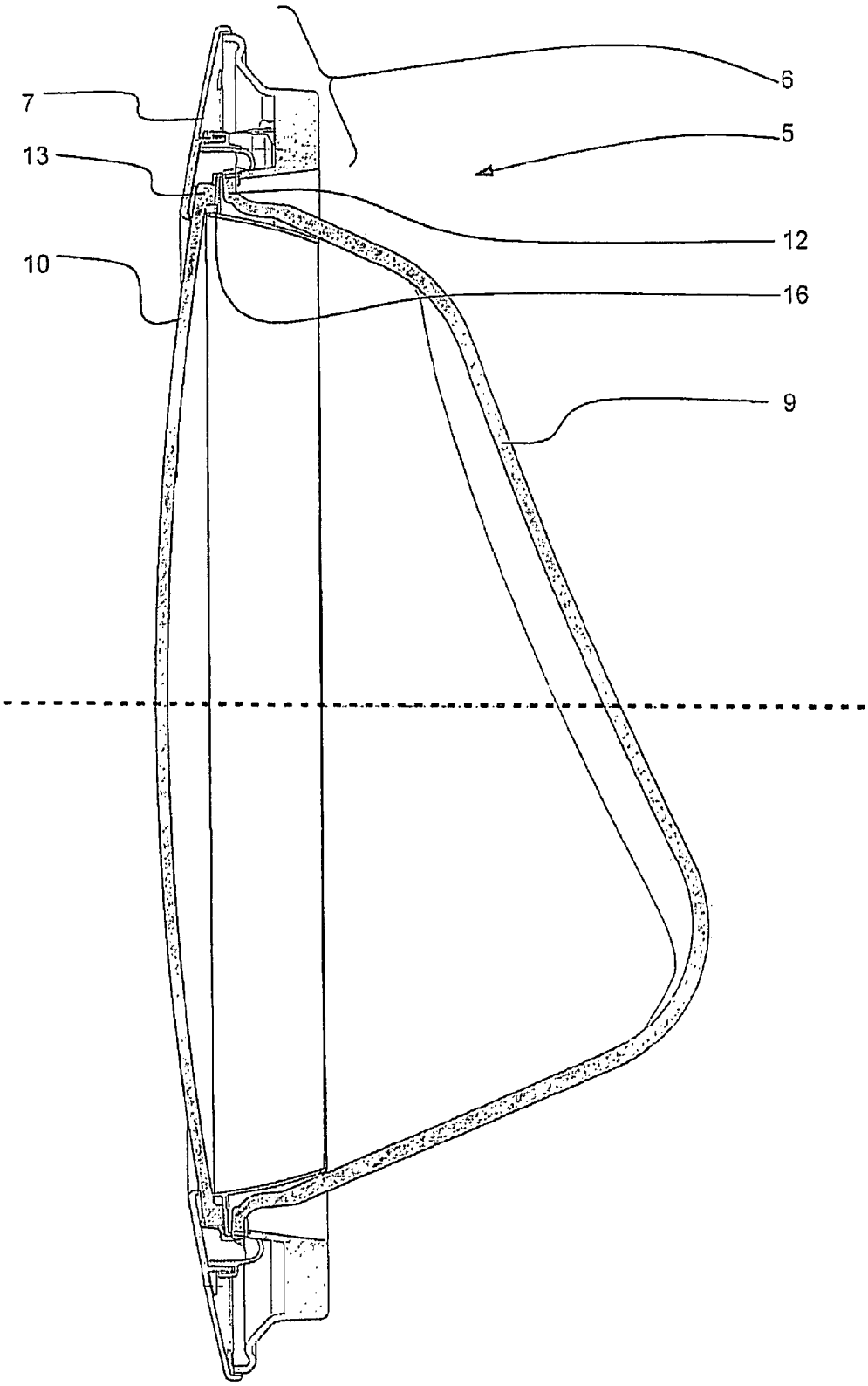
FIG. 2 shows a cross-sectional view of the porthole door.

FIG. 2 is a cross-sectional view showing the construction of porthole door 5. Frame 6 includes a cover ring 7 which is visible on the outside of laundry appliance 1 (FIG. 1). Moreover, porthole door 5 includes a highly curved door glass 9. Porthole door 5 further includes an observation window 10 which covers the inward curvature of door glass 9 on the outside of door 5. Door glass 9 and observation window 10 are held in a frame 6 surrounding door 9 and observation window 10. Frame 6 is of multi-part construction, and includes an inner ring 8 attached to the inner side of visible cover ring 7. Observation window 10 bears with its edge 13 against cover ring 7, while edge 12 of door glass 9 bears against edge 13 of observation window 10 with a sealing ring 16 being interposed therebetween. Fastening is accomplished by inner ring 8 pressing against edge 12 of door glass 9, which bears against edge 13 of observation window 10 via said sealing ring 16, the observation window, in turn, resting with its edge 13 against the inner side of cover ring 7.

Figure 3:
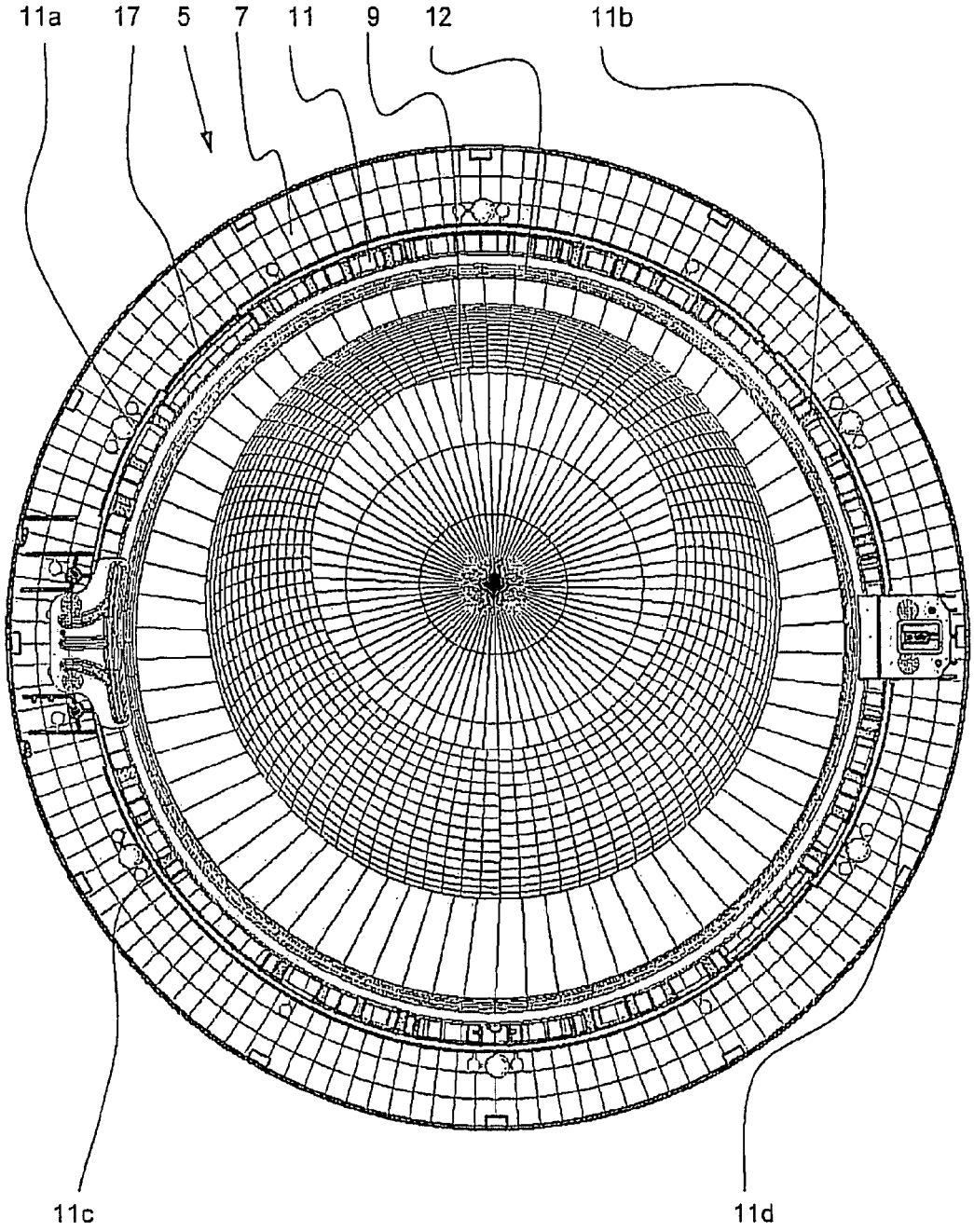
FIG. 3 shows the porthole door with the cover ring in a perspective view.

FIG. 3 is a view showing porthole door 5 from the inner side with inner ring 8 removed. Edge 12 of door glass 9 is located on cover ring 7. In order to center door glass 9 and/or observation window 10 in position, centering means 11 are provided on the inner side of cover ring 7 circumferentially around edge 12 of door glass 9. In this view, observation window 10 cannot be seen, but centering means 11 for observation window 10 is/are are similarly arranged circumferentially around the edge of the observation window. In the embodiment shown, centering means 11, 11*a*, 11*b*, 11*c*, 11*d* take the form of circular ring segments mounted on a circumferential lip 17 on the inner side of cover ring 7.

Figure 4:
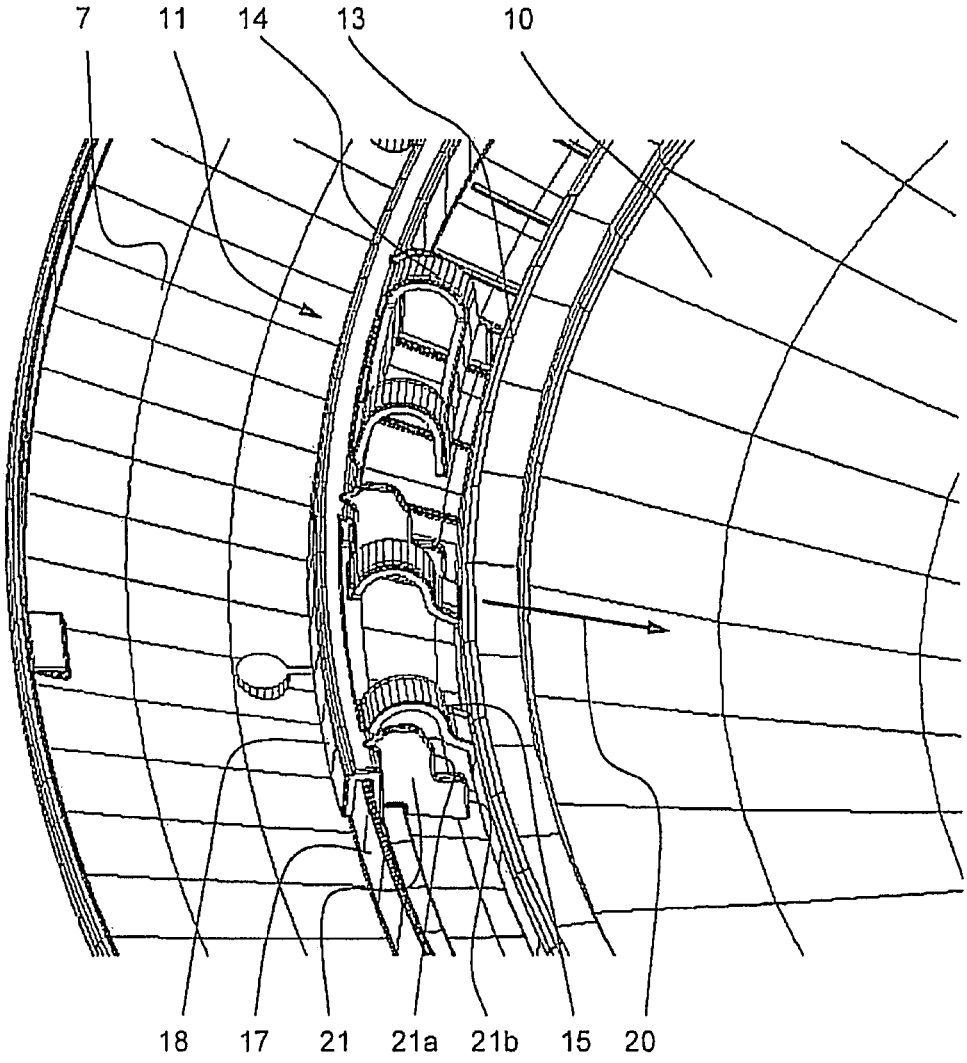
FIG. 4 shows the porthole door with the cover ring in a perspective detail view.

FIG. 4 is a detail view of centering means 11. In this view, edge 13 of observation window 10 rests against the inner side of cover ring 7. Centering means 11 includes a resilient element 15 which produces a radial force 20 acting on edge 13 of observation window 10. Because of the circumferential arrangement of resilient element 15, observation window 10 is centrally oriented or positioned on cover ring 7. Centering means 11 further includes a resilient element 14 which produces a radial force 20 acting on edge 14 of door glass 9. The centering means is/are mounted on a lip 17 on the inner side of cover ring 7. Centering means 11 further includes at least one rib-like formation 21, which serves as a stop 21*a* for observation window 10 or, respectively, as a stop 21*b* for door glass 9, and limits potential displacement of observation window 10 or door glass 9 within cover ring 7.

Figure 5:
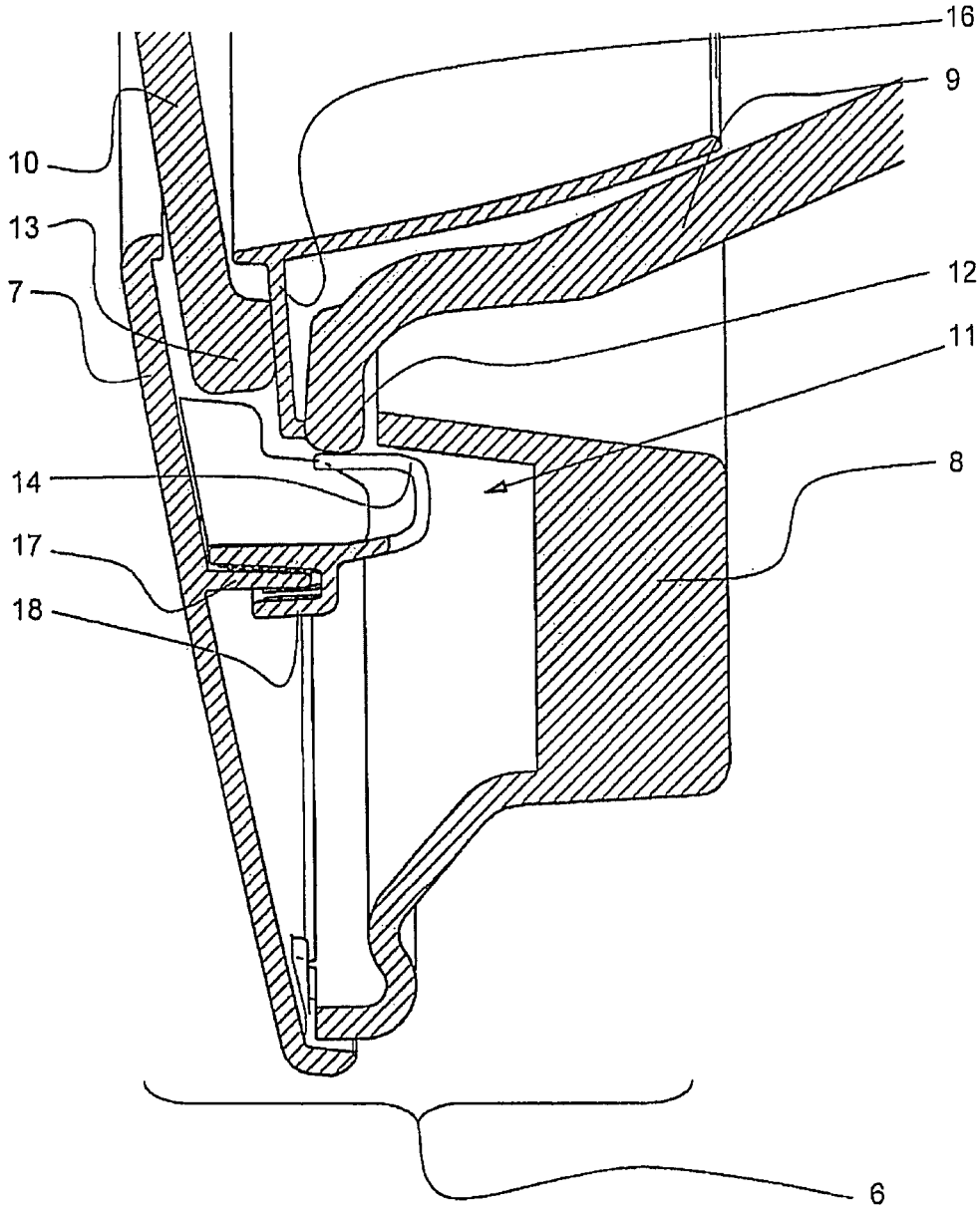
FIGS. 5, 6 show the porthole door in cross-sectional detail views.

FIG. 5 is a cross-sectional detail view illustrating the action of centering means 11 for door glass 9. Centering means 11 is provided on cover ring 7, More specifically, centering means 11 is mounted with a clamp 18 onto a lip 17 provided on the inner side of cover ring 7. Centering means 11 further includes a resilient element 14 which acts on edge 12 of door glass 9. In the mounted position, inner ring 8 presses axially against edge 12 of door glass 9, said edge pressing against edge 13 of observation window 10 via the interposed sealing ring 16. Edge 13, in turn, is pressed against the edge of the cover ring. This clamping action secures the door glass and observation window 10 within frame 6.

Figure 6:
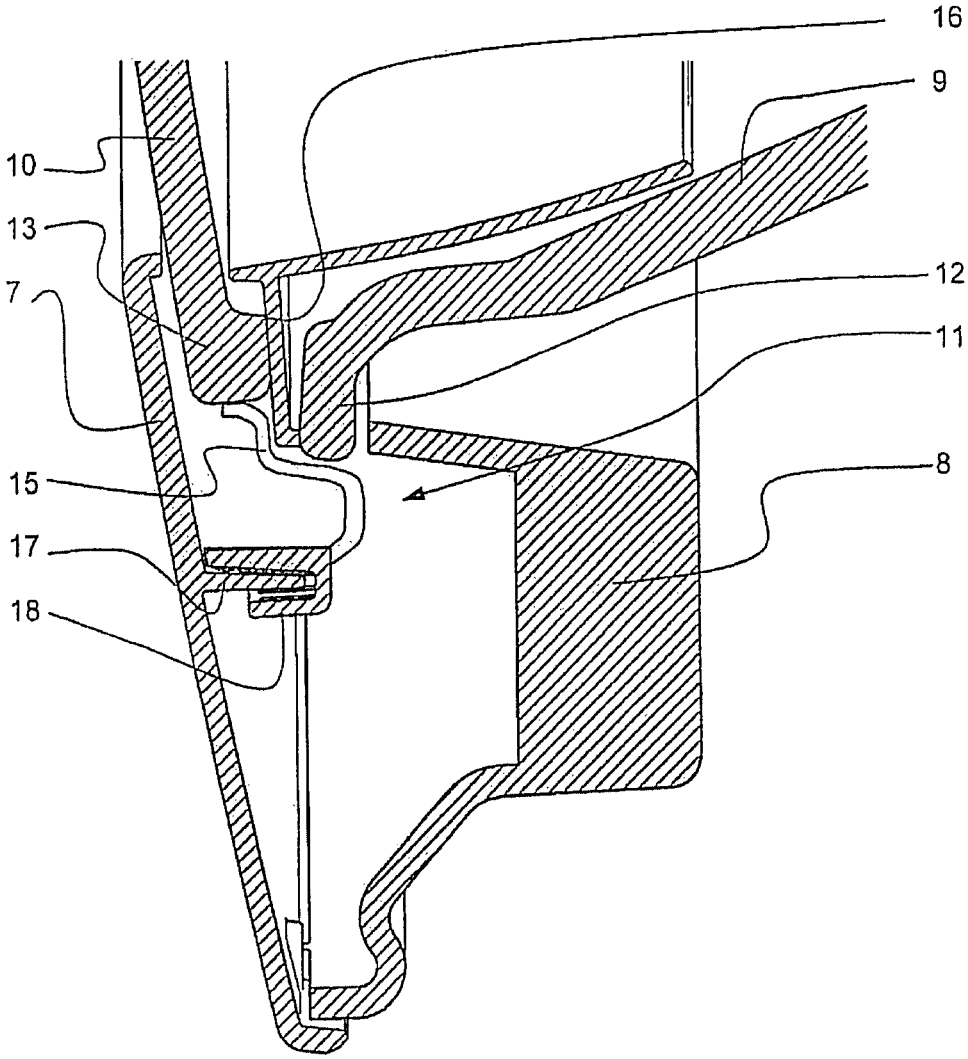

FIG. 6 is a cross-sectional detail view illustrating the action of centering means 11 for observation window 10. Centering means 11 is provided on cover ring 7, More specifically, centering means 11 is mounted with a clamp 18 onto a lip 17 provided on the inner side of cover ring 7. Centering means 11 further includes a resilient element 15 which acts on edge 13 of observation window 10. Fastening of door glass 9 and observation window 10 within frame 6 is accomplished by inner ring 8 in the manner described above.

The scope of the present invention is not limited to the exemplary embodiments described herein.

What is claimed is:

1. A porthole door for a front-loading laundry appliance, the porthole door comprising:

a door glass curved inward toward an inside of the appliance;

a frame including an inner ring and a cover ring;

a centering device disposed on the frame and including a plurality of first resilient elements, the first resilient elements configured such that the centering device bears resiliently against a peripheral edge of the door glass so as to provide a radial force acting on the door glass via the peripheral edge at various locations so as to bring the door glass into a substantially centered position within the frame;

an observation window covering a curved portion of the door glass; and an additional centering device disposed on the frame and including a plurality of second resilient elements, the second resilient elements configured such that the additional centering device bears resiliently against a peripheral edge of the observation window so as to bring the observation window into a substantially centered position within the frame.

2. The porthole door as recited in claim 1 wherein the laundry appliance is at least one of a washing machine, a washer-dryer machine and a laundry dryer.

3. The porthole door as recited in claim 1 wherein:

the plurality of first resilient elements are circumferentially and substantially uniformly distributed; and the plurality of second resilient elements are circumferentially and substantially uniformly distributed.

4. The porthole door as recited in claim 3 wherein:

each of the first and second resilient elements has a shape of a segment of a circular ring; and the first and second resilient elements are disposed circumferentially around the peripheral edge of the door glass on the cover ring of the frame.

5. The porthole door as recited in claim 3 wherein:

each of the first and second resilient elements have a shape of a segment of a circular ring; and the first and second resilient elements are disposed circumferentially around the peripheral edge of the door glass on the inner ring of the frame.

6. The porthole door as recited in claim 3 wherein:

each of the first and second resilient elements have a shape of a segment of a circular ring; and the first and second resilient elements are disposed circumferentially around the peripheral edge of the observation window on the cover ring of the frame.

7. The porthole door as recited in claim 3 wherein:

each of the first and second resilient elements have a shape of a segment of a circular ring; and the first and second resilient elements are disposed circumferentially around the peripheral edge of the observation window on the inner ring of the frame.

8. The porthole door as recited in claim 3 wherein a first ring is disposed on the cover ring of the frame, the first and second resilient elements being disposed on the first ring.

9. The porthole door as recited in claim 3 wherein a first ring is attached to the cover ring of the frame, the first and second resilient elements being disposed on the first ring.

10. The porthole door as recited in claim 3 wherein a first ring is disposed on the inner ring of the frame, the first and second resilient elements being disposed on the first ring.

11. The porthole door as recited in claim 3 wherein a first ring is attached to the inner ring of the frame, the first and second resilient elements being disposed on the first ring.

12. The porthole door as recited in claim 8 wherein the first ring is integrally formed as one piece with the first and second resilient elements.

13. The porthole door as recited in claim 9 wherein the first ring is integrally formed as one piece with the first and second resilient elements.

14. The porthole door as recited in claim 10 wherein the first ring is integrally formed as one piece with the first and second resilient elements.

15. The porthole door as recited in claim 11 wherein the first ring is integrally formed as one piece with the first and second resilient elements.

16. The porthole door as recited in claim 1 wherein the plurality of first resilient elements are circumferentially and substantially uniformly distributed.

* * * * *